US008055005B2

(12) United States Patent
Liu et al.

(10) Patent No.: US 8,055,005 B2
(45) Date of Patent: Nov. 8, 2011

(54) BLUETOOTH EARPHONE AND LANYARD STRUCTURE THEREOF

(75) Inventors: Chun-Hsin Liu, Taipei (TW); Chung-Chun Wu, Taipei (TW); Jui-Chi Liao, Taipei (TW)

(73) Assignee: Lite-On Technology Corp., Taipei (TW)

( * ) Notice: Subject to any disclaimer, the term of this patent is extended or adjusted under 35 U.S.C. 154(b) by 1224 days.

(21) Appl. No.: 11/797,308

(22) Filed: May 2, 2007

(65) Prior Publication Data

US 2008/0196210 A1 Aug. 21, 2008

(30) Foreign Application Priority Data

Feb. 16, 2007 (TW) ..... 96203251 U

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |
| *H04R 1/00* | (2006.01) |
| *A45F 5/00* | (2006.01) |
| *A45F 3/14* | (2006.01) |

(52) U.S. Cl. ..... 381/374; 381/150; 381/361; 381/364; 381/366; 381/370; 381/378; 381/380; 381/385; 224/247; 224/257

(58) Field of Classification Search ..... 381/364, 381/366, 388, 150, 361, 370, 374, 378, 380, 381/385; 24/3.4; 224/247, 257; D14/192, D14/203.5, 205–206

See application file for complete search history.

(56) References Cited

U.S. PATENT DOCUMENTS

| | | | | |
|---|---|---|---|---|
| 4,878,276 A * | 11/1989 | Morrish et al. | ..... | 24/511 |
| 5,992,715 A * | 11/1999 | Habibi | ..... | 224/247 |
| 7,110,535 B2 * | 9/2006 | Bodley et al. | ..... | 379/430 |

* cited by examiner

*Primary Examiner* — Davetta W Goins
*Assistant Examiner* — Matthew Eason
(74) *Attorney, Agent, or Firm* — Bacon & Thomas, PLLC

(57) ABSTRACT

A Bluetooth earphone and a lanyard structure thereof are provided. The Bluetooth earphone includes an earphone body and a lanyard structure. The lanyard structure includes a lanyard and a clip element. The lanyard is disposed on the clip element. The clip element includes two hooks gripping the earphone body for combining the lanyard structure with the earphone body.

12 Claims, 3 Drawing Sheets

BLUETOOTH EARPHONE AND LANYARD STRUCTURE THEREOF

This application claims the benefit of Taiwan application Ser. No. 96203251, filed Feb. 16, 2007, the subject matter of which is incorporated herein by reference.

BACKGROUND OF THE INVENTION

1. Field of the Invention

The invention relates in general to a Bluetooth earphone and a lanyard structure thereof, and more particularly to a Bluetooth earphone easy to be collected and a lanyard structure thereof.

2. Description of the Related Art

A Bluetooth earphone enables a user to answer a phone call without holding the mobile phone. The user can easily answer phone calls by the Bluetooth earphone no matter the user is shopping, driving or just sitting at a restaurant.

For convenience use, most Bluetooth earphones are small in size for the user to carry with, such that the user can leave the Bluetooth earphone at a pocket or a hang bag, or just wear the Bluetooth earphone with him/her. Currently, one way of collecting up the Bluetooth earphone is to pass a lanyard through the body of the Bluetooth earphone, such that the user can wear the lanyard around his/her neck and the Bluetooth earphone is hung in front of the chest. However, the lanyard is combined with the Bluetooth earphone and they can not be easily separated. When the user would like to answer a call, the user has to take off the Bluetooth earphone along with the lanyard from the neck, which is inconvenient.

SUMMARY OF THE INVENTION

The invention is directed to a Bluetooth earphone and a lanyard structure thereof. The clip element of the lanyard structure fixes the lanyard on the Bluetooth earphone, such that a user can conveniently carry the Bluetooth earphone. When the user would like to wear the Bluetooth earphone, the user only needs to release the Bluetooth earphone from the clip element of the lanyard structure, and then the Bluetooth earphone is detached from the lanyard structure.

According to a first aspect of the present invention, a lanyard structure used in a Bluetooth earphone is provided. The lanyard structure includes a lanyard and a clip element. The clip element includes two hooks gripping the Bluetooth earphone for combining the clip element and the lanyard with the Bluetooth earphone.

According to a second aspect of the present invention, a Bluetooth earphone including an earphone body and a lanyard structure is provided. The lanyard structure includes a lanyard and a clip element. The lanyard is disposed on the clip element. The clip element includes two hooks gripping the earphone body for combining the lanyard structure with the earphone body.

The invention will become apparent from the following detailed description of the preferred but non-limiting embodiments. The following description is made with reference to the accompanying drawings.

DETAILED DESCRIPTION OF THE INVENTION

Figure 1A:
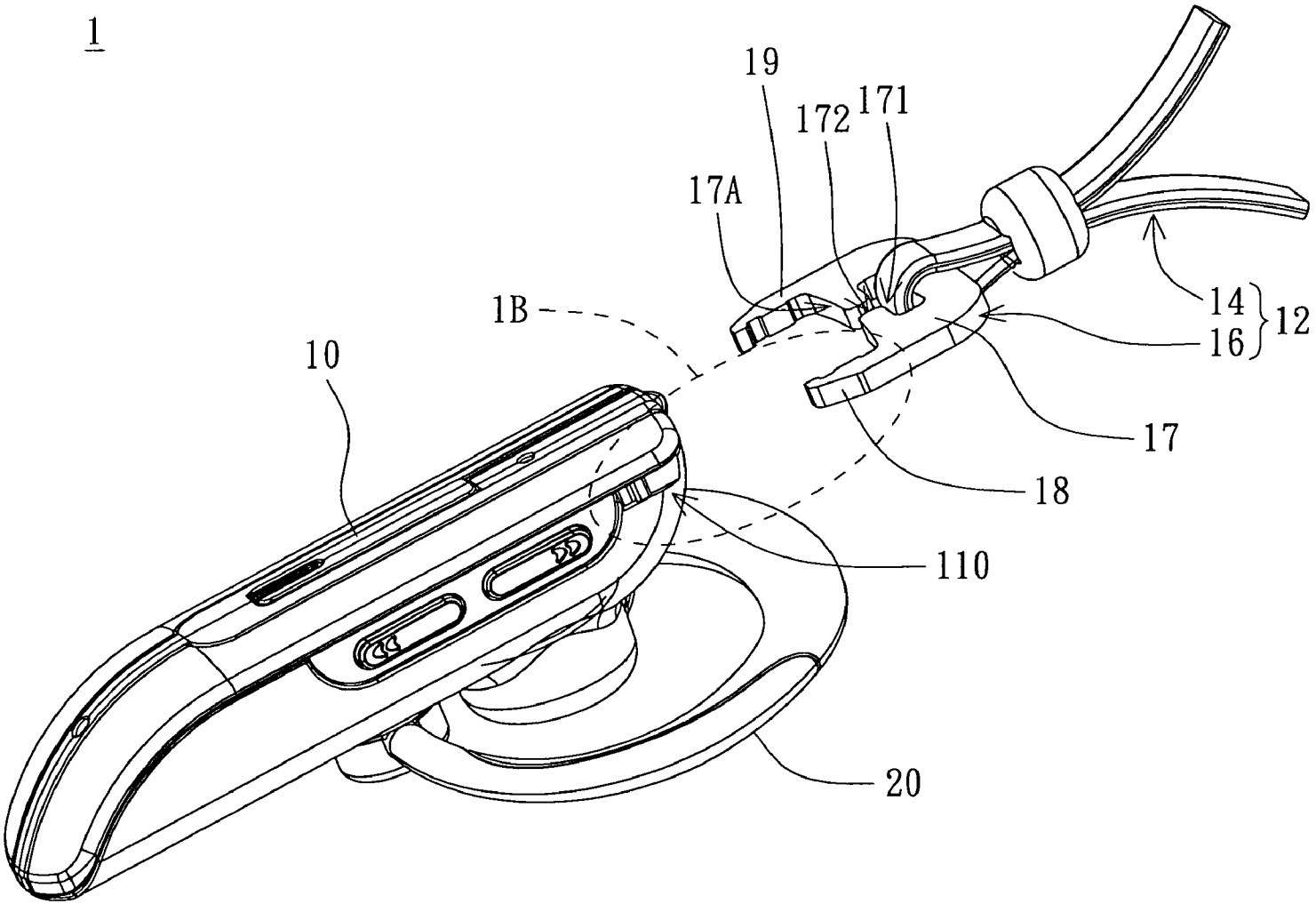
FIG. 1A is a perspective of a Bluetooth earphone according to a preferred embodiment of the invention.
Figure 1B:
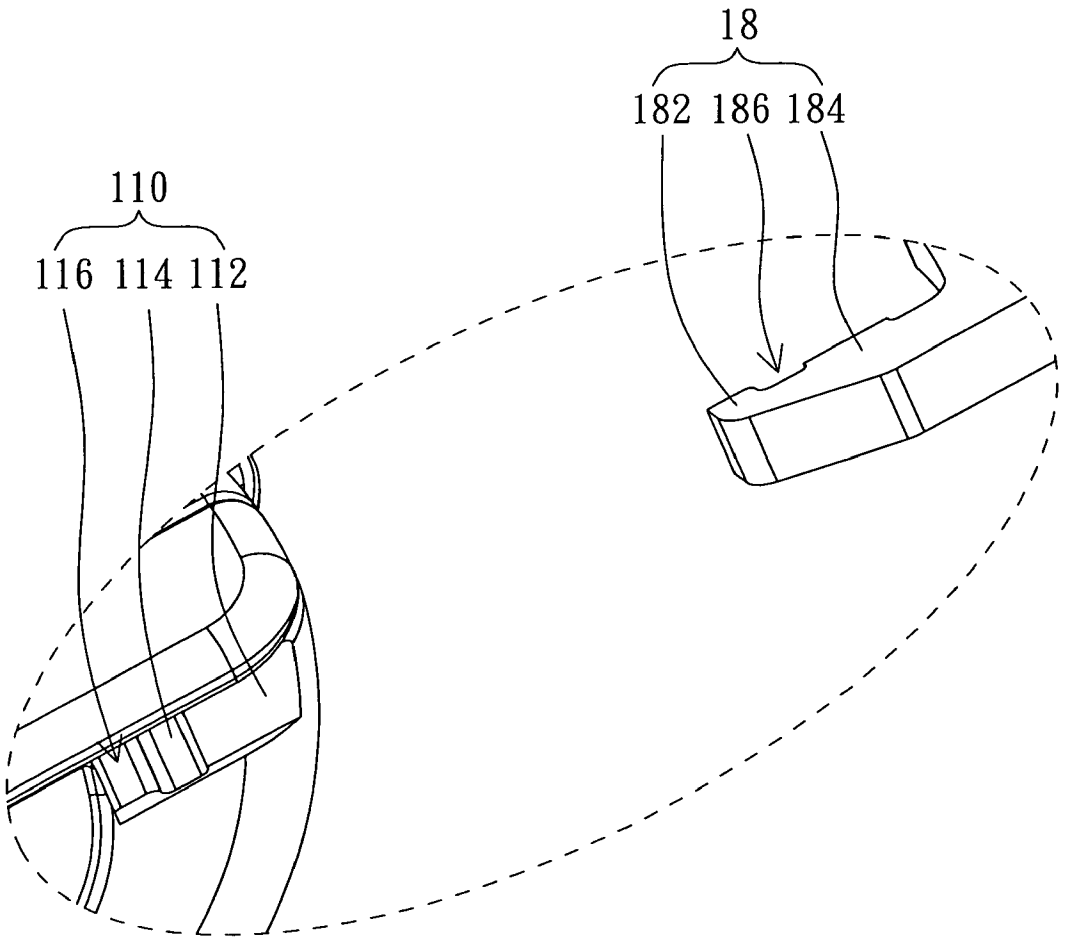
FIG. 1B is a partial enlargement of the earphone body of FIG. 1A.
Figure 2:
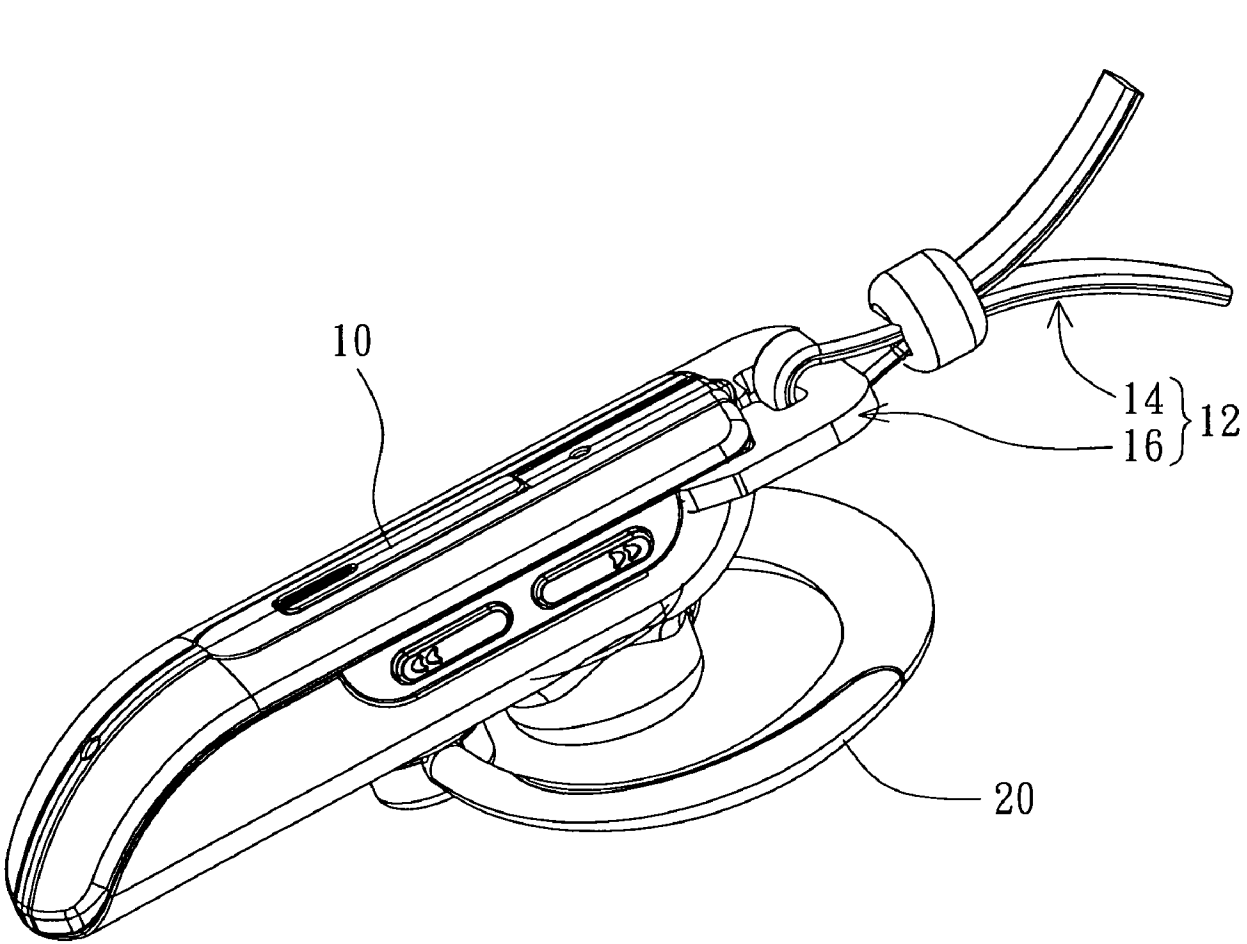
FIG. 2 is an assembly diagram of the earphone body and the lanyard structure of FIG. 1A.

Please refer to FIGS. 1A~1B. FIG. 1A is a perspective of a Bluetooth earphone according to a preferred embodiment of the invention. FIG. 1B is a partial enlargement of the earphone body of FIG. 1A. Also referring to FIG. 2, an assembly diagram of the earphone body and the lanyard structure of FIG. 1A is shown. As indicated in FIG. 1A, the Bluetooth earphone 1 includes an earphone body 10 and a lanyard structure 12. The lanyard structure 12 includes a lanyard 14 and a clip element 16, wherein the lanyard 14 is disposed on the clip element 16. The clip element 16 includes a clip main body 17 and two hooks 18 and 19 connected to the clip main body 17. The hooks 18 and 19 combine the lanyard structure 12 with the earphone body 10 as indicated in FIG. 2.

The clip main body 17 of the lanyard structure 12 includes a hole 171. The lanyard 14 passes through the hole 171 to be combined with the clip element 16. The clip main body 17 further includes an open slot 172. The open slot 172 is extended from a side rim 17A of the clip main body 17 to the hole 171. The hooks 18 and 19 are extended from two ends of the side rim 17A and form a U-shaped structure with the clip main body 17. The clip element 16 is made from plastic material for example, such that the structure of the clip element 16 is similar to an elastic structure.

As for the lanyard 14 of the lanyard structure 12, it enables the user to carry the Bluetooth earphone 1 more conveniently. Preferably, the length of the lanyard 14 is adjustable, such that the user can wear the Bluetooth earphone 1 around the neck or the wrist.

As indicated in FIG. 1A, two symmetric grooved portions 110 (only one grooved portion is illustrated due to the restriction of view angle) are disposed on two lateral sides of the earphone body 10. The grooved portions 110 are engaged with the two hooks 18 and 19 for fixing the clip element 16 on the earphone body 10. The engagement between the hooks 18 and the grooved portions 110 is elaborated below.

As indicated in FIG. 1B, the grooved portion 110 includes a guiding slot 112, a protrusion 114 and a groove hole 116. The guiding slot 112 is positioned at the front end of the grooved portion 110, the groove hole 116 is positioned at the rear end of the grooved portion 110, and the protrusion 114 is positioned between the guiding slot 112 and the groove hole 116. Preferably, the groove hole 116 is deeper than the guiding slot 112. That is, the grooved portion 110 has three portions, namely, the guiding slot 112, the protrusion 114, and the groove hole 116, wherein the groove hole 116 is deeper than the guiding slot 112. The guiding slot 112 is used for facilitating the hook 18 to reach the engaging position. The protrusion 114 and the groove hole 116 allow the hook 18 to be engaged with the grooved portion 110.

To cooperate with the three-section design of the grooved portion 110, the hook 18 has an indent 186 positioned between the hook front end 182 and the hook rear end 184. The indent 186 is disposed on the inner surface of the hook 18 (referring to FIG. 1A) and is used to engage with the protrusion 114 of the grooved portion 110, wherein the inner surface of the hooks 18 is opposite to that of the hook 19. When the clip element 16 is disposed on the earphone body 10, the hook front end 182 of the hook 18 is embedded in the groove hole 116, the protrusion 114 of the grooved portion 110 is embedded in the indent 186 of the hooks 18, and the hook rear end 184 is restrained within the guiding slot 112. The assembly of the lanyard structure 12 and the earphone body 10 is elaborated below.

When assembling the clip element 16 with the earphone body 10, the hooks 18 and 19 firstly slide into the grooved portion 110 from the two lateral sides of the earphone body 10. As the hook front end 182 of the hooks 18 slides to the protrusion 114 from the guiding slot 112 (approximately position ⅔ of the grooved portion 110), the hooks 18 and 19 can be slightly pushed outwardly by the protrusion 114 due to the elastic structure and the open slot 172 of the clip element 16 (referring to FIG. 1A). When the hook 18 continues to slide within the grooved portion 110, the protrusion 114 of the grooved portion 110 will be embedded in the indent 186 of the hook 18, and the hook front end 182 is embedded in the groove hole 116 as well. Thus, the hooks 18 and 19 are fixed on the earphone body 10. Because the groove hole 116 is deeper than the guiding slot 112 positioned at the front end of the grooved portion 110, the hook front end 182 is tightly embedded in the groove hole 116. Furthermore, as the protrusion 114 is embedded in the indent 186 of the hooks 18 and the hook rear end 184 is restrained within the guiding slot 112, the hooks 18 is completely and tightly embedded in the grooved portion 110.

On the contrary, when the clip element 16 is detached from the earphone body 10, the hook front end 182 of the hook 18 is expanded outwardly by the protrusion 114 first and then detached from the grooved portion 110. Thus, the clip element 16 is apart from the earphone body 10.

With the sliding movement of the hooks 18 and 19 on the grooved portion 110, along with the positioning design between the hooks 18 and 19 on the grooved portion 110, it provides the user with not only the facilitation of combining the lanyard structure 12 and the earphone body 10, but also the sense that the hooks 18 and 19 are sliding on the grooved portion 110. The user can even hear the click sound and ascertain that the hooks 18 and 19 have been embedded in the groove hole 116. Thus, the user would know that the lanyard structure 12 is already combined with the earphone body 10 tightly and the Bluetooth earphone is received properly.

Moreover, the Bluetooth earphone 1 includes an ear hook 20 that is disposed on the earphone body 10. The ear hook 20 allows the user to wear the Bluetooth earphone 1 on the ear to hear sounds.

No matter the user is using the Bluetooth earphone 1 indoors or outdoors, the lanyard structure 12 is helpful for the user to collect and use the Bluetooth earphone 1. For example, referring to FIG. 1A, when combining the lanyard structure 12 with the earphone body 10, the hooks 18 and 19 are slightly expanded due to the elastic structure of the clip element 16. Meanwhile, the hooks 18 and 19 slide into the grooved portions 110 positioned on the two lateral sides of the earphone body 10. After the clip element 16 is fixed on the earphone body 10, the user can wear the Bluetooth earphone 1 around the neck or on the wrist. When the user would like to answer a phone call with the Bluetooth earphone 1, the user only needs to release the earphone body 10 from the clip element 16 of the lanyard structure 12, and then to wear the Bluetooth earphone 1 on the ear via the ear hook 20.

According to the Bluetooth earphone and the lanyard structure thereof disclosed in the above preferred embodiment of the invention, the lanyard of the lanyard structure is combined with the Bluetooth earphone via the clip element of the lanyard structure, such that the user can conveniently carry and collect the Bluetooth earphone. The clip element with the characteristics of elastic structure facilitates the combination between the Bluetooth earphone and the lanyard structure or the detachment of the lanyard structure from the Bluetooth earphone. The Bluetooth earphone and the lanyard structure thereof disclosed in the above preferred embodiment of the invention have the advantages of easy collecting and carrying.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lanyard structure used in a Bluetooth earphone, the lanyard structure comprising:
   a lanyard; and
   a clip element having two hooks gripping the Bluetooth earphone for combining the clip element and the lanyard with the Bluetooth earphone;
   wherein, the lateral sides of the Bluetooth earphone have two grooved portions for engaging with the two hooks to fix the two hooks on the two grooved portions;
   wherein each of the two hooks has an indent, the two indents are respectively positioned on the two opposite inner surfaces of the two hooks, the two grooved portions each has a protrusion, and when the clip element is disposed on the Bluetooth earphone, the protrusion on each of the two grooved portions is embedded into the indent on each of the two hooks for fixing the clip element on the Bluetooth earphone.

2. The lanyard structure according to claim 1, wherein the clip element comprises a clip main body, the two hooks respectively connect the clip main body.

3. The lanyard structure according to claim 2, wherein the clip main body has a hole, the lanyard passes through the hole to be combined with the clip element.

4. The lanyard structure according to claim 3, wherein the clip main body further has an open slot, the open slot is extended from a side rim of the clip main body to the hole, and the side rim is positioned between the two hooks.

5. The lanyard structure according to claim 1, wherein the front end of each of the two grooved portions is a guiding slot, the rear end of each of the two grooved portions is a groove hole, the protrusion is positioned between the guiding slot and the groove hole;
   the front ends of the two hooks slide into the two grooved portions via the two guiding slots, when the protrusion of each of the two grooved portions is embedded into the indent of each of the two hooks, the front ends of the two hooks are embedded into the two groove holes of the two grooved portions.

6. The lanyard structure according to claim 1, wherein the materials of the clip element include plastics.

7. A Bluetooth earphone, comprising:
   an earphone body; and
   a lanyard structure having a lanyard and a clip element, wherein the lanyard is disposed on the clip element, the clip element comprises two hooks gripping the earphone body for combining the lanyard structure with the earphone body;
   wherein, the lateral sides of the earphone body have two grooved portions for engaging with the two hooks;
   wherein the two grooved portions each has a protrusion, each of the two hooks has an indent, the two indents are respectively positioned on the two opposite inner surfaces of the two hooks, and when the clip element is disposed on the earphone body, the protrusion on each of the two grooved portions is embedded into the indent of each of the two hooks for fixing the clip element on the earphone body.

8. The Bluetooth earphone according to claim 7, wherein the clip element comprises a clip main body, the two hooks respectively connect the clip main body.

9. The Bluetooth earphone according to claim 8, wherein the clip main body has a hole, the lanyard passes through the hole to be combined with the clip element.

10. The Bluetooth earphone according to claim 9, wherein the clip main body has an open slot, the open slot is extended from a side rim of the clip main body to the hole, the side rim is positioned between the two hooks.

11. The Bluetooth earphone according to claim 7, wherein the front end of each of the two grooved portions is a guiding slot, the rear end of each of the two grooved portions is a groove hole, the protrusion is positioned between the guiding slot and the groove hole;

the front ends of the two hooks slide into the two grooved portions via the two guiding slots, when the protrusion of each of the two grooved portions is embedded into the indent of each of the two hooks, the front ends of the two hooks are embedded into the two groove holes of the two grooved portions.

12. The Bluetooth earphone according to claim 7, wherein the materials of the clip element include plastics.

* * * * *